US006483490B1

(12) United States Patent
Lo

(10) Patent No.: US 6,483,490 B1
(45) Date of Patent: Nov. 19, 2002

(54) METHOD AND APPARATUS FOR PROVIDING SUSTAINING WAVEFORM FOR PLASMA DISPLAY PANEL

(75) Inventor: Shin-Tai Lo, Miao-Li (TW)

(73) Assignee: Acer Display Technology, Inc., Hsinchu (TW)

( * ) Notice: Subject to any disclaimer, the term of this patent is extended or adjusted under 35 U.S.C. 154(b) by 0 days.

(21) Appl. No.: 09/532,905

(22) Filed: Mar. 22, 2000

(51) Int. Cl.[7] ..... G09G 3/28

(52) U.S. Cl. ..... 345/60; 345/63; 345/67; 345/68; 315/169.4

(58) Field of Search ..... 345/60, 63, 66, 345/67, 68; 315/169.4

(56) References Cited

U.S. PATENT DOCUMENTS

| | | | | |
|---|---|---|---|---|
| 5,828,353 A | * | 10/1998 | Kishi et al. | 345/55 |
| 5,943,030 A | * | 8/1999 | Minamibayashi | 315/169.3 |
| 5,994,929 A | * | 11/1999 | Sano et al. | 327/110 |
| 6,011,355 A | * | 1/2000 | Nagai | 315/169.3 |
| 6,111,556 A | * | 8/2000 | Moon | 345/60 |
| 6,150,999 A | * | 11/2000 | Chen et al. | 345/37 |
| 6,175,192 B1 | * | 1/2001 | Moon | 315/169.3 |

* cited by examiner

*Primary Examiner*—Bipin Shalwala
*Assistant Examiner*—Jimmy H. Nguyen
(74) *Attorney, Agent, or Firm*—Rabin & Berdo, P.C.

(57) ABSTRACT

A method for providing the sustaining waveform to a selected discharge cell of a plasma display panel (PDP) is provided. First, a first pulse of a first voltage falls to a reference voltage is applied between sustain electrodes X and Y. Second, the voltage between electrodes X and Y remains at the reference voltage for a first period. Finally, a second pulse of a second voltage remains at the second voltage for a second period, and falls to the reference voltage is applied between sustain electrodes X and Y. The apparatus for providing the sustaining waveform to a selected discharge cell of a plasma display panel (PDP) includes a first energy recovery circuit, a second energy recovery circuit, a first capacitor and a first bi-directional switch, and a second capacitor and a second bi-directional switch. The first energy recovery circuit, which includes a first inductor and four switches, is connected to the first sustain electrode. The second energy recovery circuit, which includes a second inductor and four switches, is connected to the second sustain electrode. Moreover, the first capacitor and the first bi-directional switch are connected in series between the first sustain electrode and a first node, and the second capacitor and the second bi-directional switch are connected in series between the second sustain electrode and a second node.

8 Claims, 9 Drawing Sheets

METHOD AND APPARATUS FOR PROVIDING SUSTAINING WAVEFORM FOR PLASMA DISPLAY PANEL

BACKGROUND OF THE INVENTION

1. Field of the Invention

The invention relates in general to switching circuitry for driving plasma display panels (PDPs), and more particularly to a method and an apparatus for driving plasma display panels to enhance the luminous efficiency.

2. Description of the Related Art

AC plasma display panels (ACPDPs) have the following advantages: large screens, wide viewing angle, large capacity, and the ability to display full-color images, However, their disadvantage of high power consumption needs to be overcome. In order to improve the efficiency of AC-PDPs, energy recovery is a necessary function of the driving circuit of the plasma display panels. Moreover, modifying the sustaining waveform for driving ACPDPs is an alternative way to improve the luminous efficiency.

The driving waveform of AC-PDPs essentially has three periods: a reset period, a write (address) period, and a sustain discharge period. To ensure the accuracy of addressing, an erase pulse is applied during the reset period, and the wall charges in all discharge cells are cleared. In the write period, the discharge cells of ACPDP are selected according to the display image data to write and therefore the wall charges exist in the ON cells. As a result of the wall charge's memory effect, the selected discharge cells discharge to emit light pulses continuously as long as a moderate alternating voltage is applied between the sustain electrodes X and Y during the sustain discharge period.

In FIG. 1, a conventional sustaining waveform and the corresponding light emitting pulses are shown. The horizontal axis represents the time. The vertical axis represents the applied voltage between the sustain electrodes X and Y, which is denoted by $V_{xy}$, and the light emitting power. At $t_1$, $t_2$, and $t_3$, during which the wall voltage plus the applied voltage exceeds a firing voltage, light emitting pulses are generated.

Discharging current is one of the factors influencing the luminance and the luminous efficiency of AC-PDPs. As disclosed in "Basic Study on the Gas-Discharge Panel for Luminescent Color Display", IEEE Trans. Electron Devices, vol. 25, pp.1094–1100, 1978 by T. Kamegaya, H. Matsuzaki, M. Yokozawa, the luminance reaches saturation and the luminous efficiency decreases as the discharging current reaches to a critical value. Thus, by choosing appropriate operating points of the discharge current, higher luminous efficiency can be obtained.

FIG. 2 is another sustaining waveform differed from the one in FIG. 1. The horizontal axis represents time. The vertical axis represents the applied voltage $V_{xy}$ and the light emitting power. As disclosed in "Improvement of Luminous efficiency in an ACPDP by Self-Erase Discharge Waveform", SID'99 Digest, pp. 540–543, 1999, by T. Hashimoto, A. Iwata, a self-erase discharge is applied to lower the main discharging and therefore, the luminous efficiency is improved. The self-erase discharge can be improved by decreasing the falling rate and the pulse width of the sustain voltage and by applying an assistant pulse to the ACPDP. For example, the assistant pulses are applied at $t_1$, $t_3$, $t_5$, and $t_7$. The assistant pulse applied at $t_1$ has a period of $T_1$ and an amplitude of $V_1$ in FIG. 2. Consequently, the self-erase discharge occurs at $t_1$, $t_3$, $t_5$, and $t_7$ while the main discharge occurs at $t_2$, $t_4$, and $t_6$. Before the main discharge, the wall charge is reduced because of the self-erase discharge. However, the assistant pulses will attract the space charge produced by the self-erase discharge and even make the main discharge too weak if the period of the assistant pulse is too long. As a result, the sustaining frequency must be high and the margin of the sustain voltage becomes narrow. Additionally, according to the previous experiments the luminous efficiency is reduced when the sustaining frequency is higher.

SUMMARY OF THE INVENTION

It is therefore an object of the invention to provide a method and an apparatus for driving plasma display panel to improve the luminous efficiency with power recovery. The proposed sustaining waveform can be operated at the appropriate frequency to get a large sustain voltage margin. Under an experiment of a 42-inch ACPDP, the luminous efficiency is enhanced by more than 30%.

The invention achieves the above-identified objects by providing a method for sustaining discharging in the discharge cells of a plasma display panel (PDP) having first sustain electrodes, second sustain electrodes, and address electrodes. The first sustain electrodes are arranged in parallel with the second sustain electrodes. The address electrodes are arranged orthogonal to the first sustain electrodes and said second electrodes. The first sustain electrodes and the second sustain electrodes intersect with the address electrodes to form intersections which define discharge cells that can be selectively turned ON and OFF. First, a first pulse of a first positive voltage is applied between the first sustain electrodes and the second sustain electrodes. Next, the voltage between the first sustain electrodes and the second sustain electrodes maintains at a second positive voltage for a first period. Then, a second pulse of a third positive voltage is applied between the first sustain electrodes and the second sustain electrodes. After that, a third pulse of a first negative voltage is applied between the first sustain electrodes and the second sustain electrodes. Then, the voltage between the first sustain electrodes and the second sustain electrodes maintains at a second negative for a second period. Finally, a fourth pulse of a third negative voltage is applied between the first sustain electrodes and the second sustain electrodes. The second positive voltage is lower than the first positive voltage and the third positive voltage, and the second negative voltage is higher than the first negative voltage and the third negative voltage.

It is therefore another object to provide an apparatus for providing sustaining waveform to a discharge cell of a plasma display panel (PDP). The selected discharge cell is defined by a first sustain electrode, a second sustain electrode which is parallel to the first sustain electrode, and an address electrode which is orthogonal to the first sustain electrode and second sustain electrode. The apparatus includes a first energy recovery circuit, a second energy recovery circuit, a first capacitor and a ninth switch, and a second capacitor and a tenth switch. The first energy recovery circuit, which includes a first inductor and four switches, is connected to the first sustain electrode. In the first energy recovery circuit, A first switch is connected between the first sustain electrode and a power supply. A second switch is connected between the first sustain electrode and ground. A first inductor is connected between the first sustain electrode and a first node. A third switch is connected between the first node and the power supply. A fourth switch is connected between the first node and ground. The second energy recovery circuit is connected to the second sustain electrode. The second energy recovery circuit includes a second inductor and another four switches. The fifth switch is connected between the second sustain electrode and the power supply. The sixth switch is connected between the second sustain electrode and ground. The second inductorA is connected between the second sustain electrode and a second node. The seventh switch is connected between the second node and the power supply. The eighth switch is connected between the second node and ground. Moreover, the first capacitor and the ninth switch are connected in series between the first sustain electrode and the first node, and the second capacitor and the tenth switch are connected in series between the second sustain electrode and the second node.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

According to the spirit of the invention, a sustaining waveform for improving the luminous efficiency and a corresponding driving circuit with power recovery is disclosed.

Figure 3:
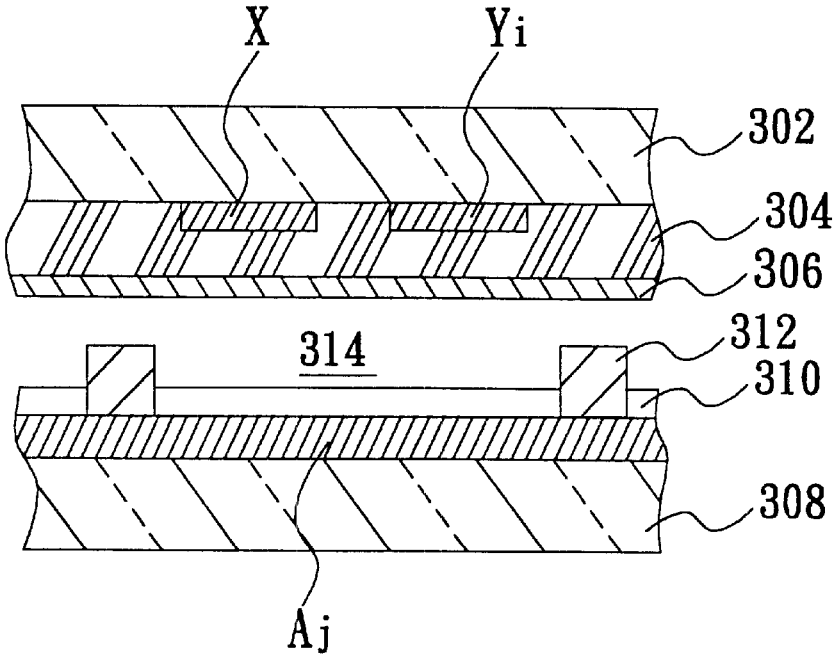
FIG. 3 (PRIOR ART)
FIG. 3 shows a sectional diagram of a discharge cell in an ACPDP.
Figure 4:
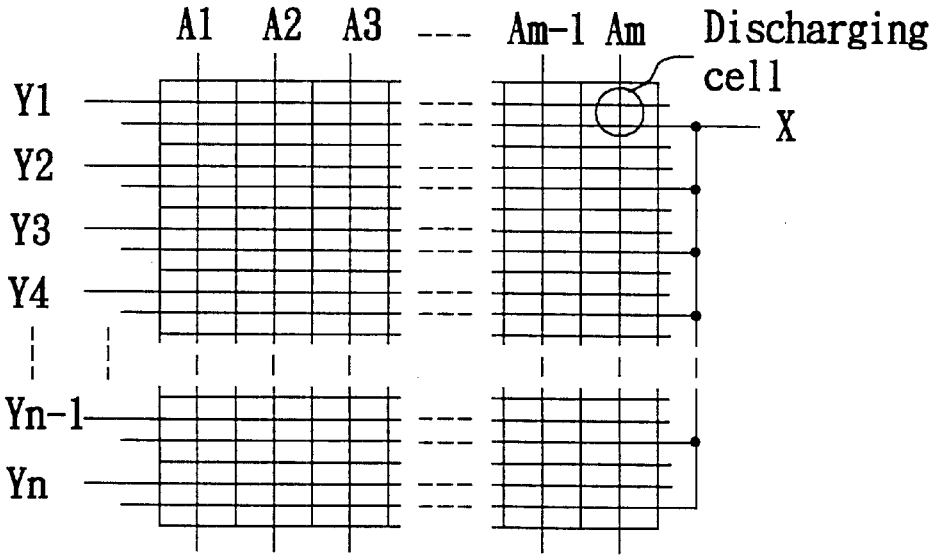
FIG. 4 (PRIOR ART)
FIG. 4 schematically shows a diagram including electrodes and m*n discharge cells of an ACPDP.

FIG. 3 shows a sectional diagram of a discharge cell in an ACPDP, and FIG. 4 schematically shows a diagram including electrodes and m*n discharge cells of an ACPDP. FIG. 3 shows a discharge cell forming a pixel at an intersection of the "i"th line (Yi) and "j"th column (Aj) of an ACPDP having three electrodes shown in FIG. 4. For simplicity, the sustain electrode Y represents one of the sustain electrodes Y1 to Yn, and the address A represents one of the address electrodes A1 to Am.

In FIG. 3, the front glass substrate 302 has sustain electrodes X and Y which are alternately disposed in pairs to be parallel with each other. The sustain electrodes X and Y are covered with the dielectric layer 304 for accumulating wall charges. The dielectric layer 304 is covered with the protective film 306. The address electrode A is orthogonal to the sustain electrodes X and Y and is formed on a rear glass substrate 308 that faces the glass substrate 302. The address electrode A is covered with dielectric phosphor 310. The rib 312 is formed on the glass substrate 308 along a boundary of the pixel. The discharge space 314 is defined between the protective film 306 and the phosphor 310. The discharge space 314 is filled with discharge gas consisting of neon mixed with xenon.

As shown in FIG. 4, the ACPDP has "n*m" pixels with i=1 to n and j=1 to m. A discharge cell (pixel) is formed at an intersection of the sustain electrode Y1 and an address electrode Aj. The discharge cell is turned ON and off. The sustain electrodes Y1 to Yn are insulated from one another, and the address electrodes A1 to Am are insulated from one another. The sustain electrodes X extend in parallel with the sustain electrodes Y1 to Yn, respectively, and one end of each of the sustain electrodes X are connected together.

Different pulses, such as priming pulses, scanning pulses, data pulses, sustaining pulses and erasing pulses, are applied to sustain electrodes X and Y and address electrodes A. The priming pulses in reset period are applied for forcibly exciting the discharge between the sustain electrodes X and Y, and the charged particles are generated in the discharge space 314. The pixels are selected to be written by the scanning pulses and the data pulses. The sustaining pulse sustains the discharge and emission of light, and the erasing pulses erases the charge.

Figure 5:
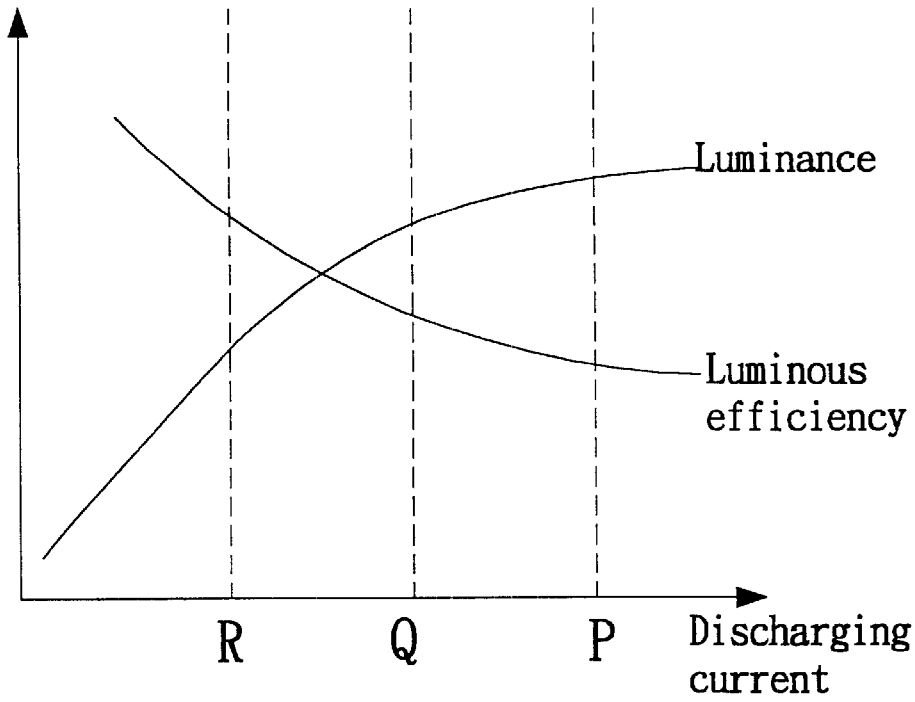
FIG. 5 (PRIOR ART)
FIG. 5 shows the diagram which indicates the relations between discharging current and luminous efficiency and luminance.

FIG. 5 indicates the relation between discharging current and luminous efficiency and luminance. The luminance saturates when the discharge current increases to a certain level. For example, when the discharging current is close to the operating point P, if the discharging current increases 10%, the luminance will increase less than 10%, therefore the luminous efficiency decreases dramatically. Conventionally, a single operating point P, at which sustain discharge occurs, is chosen for conventional sustaining operation. However, in order to obtain higher luminous efficiency, sustain discharge with lower discharge current than that of the point P is required. According to a preferred embodiment of the invention, two operating points Q and R are selected for the sustain discharge. The point R is the self-erase discharge operating point and the point Q is the main discharge operating point. It is well understood that the luminance is decided by the number of the sustain pulses. Although the discharging current of each points Q and R is lower than that of the point P, better luminous efficiency can be achieved according to the preferred embodiment of the invention. Therefore, designing a moderate sustaining waveform to lower the main discharging current with self-erase discharge is a good method to enhance the luminous efficiency.

Figure 6:
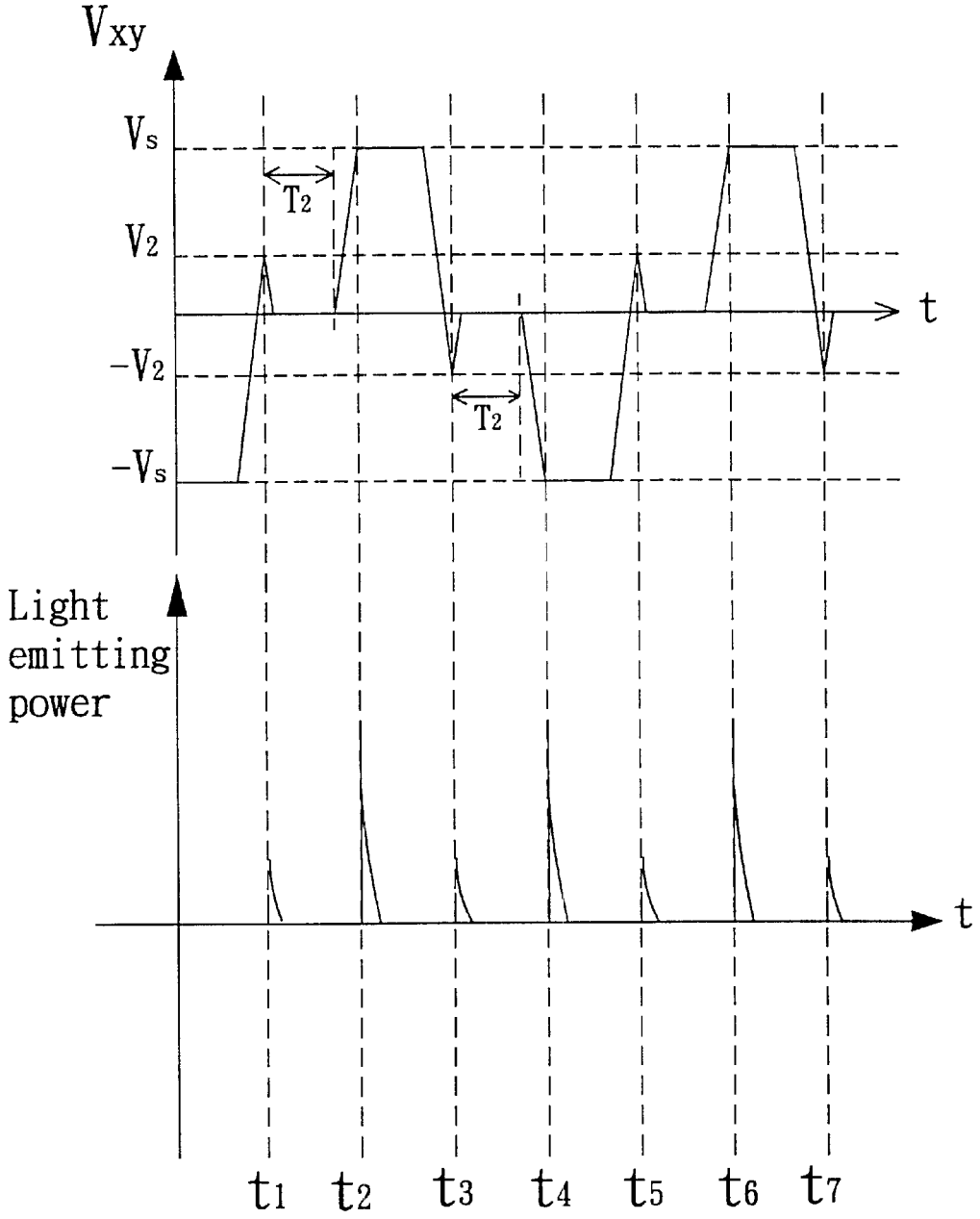
FIG. 6 shows a sustaining waveform for driving an ACPDP according to a preferred embodiment of the invention.

FIG. 6 shows a sustaining waveform for driving an ACPDP according to a preferred embodiment of the invention. The horizontal axis represents the time, while the vertical axis represents the applied voltage $V_{XY}$ and the light emitting power. The method for providing the sustaining waveform to the discharge cells includes the following steps. (1) At time t1, a positive assistant pulse is applied between sustaining electrodes X and Y, so the $V_{xy}$ increases to $V_2$. For easy description, the voltage across the sustain electrodes X and Y is denoted by $V_{XY}$. (2) Afterward, $V_{XY}$ returns to a voltage, which is closed to ground and remains at that voltage for an idle period $T_2$. (3) at time t2, $V_{XY}$ raises to a sustain voltage $V_S$ and remains at the sustain voltage $V_S$ for a certain period. (4) at time t3, a negative assistant pulse is applied between sustaining electrodes X and Y, so the $V_{XY}$ decreases to $-V_2$. (5) Sequentially, $V_{XY}$ returns to a voltage, which is closed to ground and remains at that voltage for the same idle period $T_2$. (6) at time t4, $V_{XY}$ falls to a sustain voltage $-V_S$ and remains at the sustain voltage $-V_S$ for a certain period. (7) at time t5, a positive assistant pulse is applied between sustaining electrodes X and Y again, so the $V_{XY}$ increases to $V_2$ again. These pulses are repeated to supply the sustain voltage to the discharge cells of the AC-PDPs. The self-erase discharges occur at $t_1$, $t_3$, $t_5$ and $t_7$, while the main discharge occurs at $t_2$, $t_4$, and $t_6$.

Figure 1:
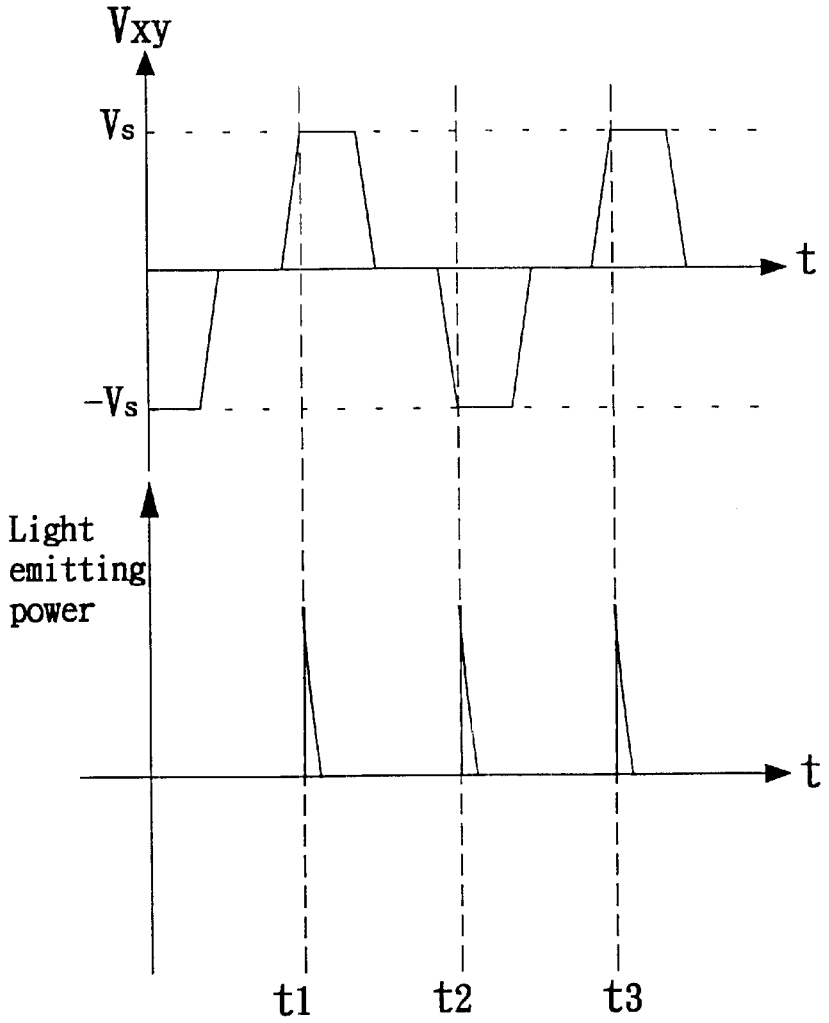
FIG. 1 (PRIOR ART)
FIG. 1 shows a conventional sustaining waveform and the corresponding light emitting pulses.
Figure 2:
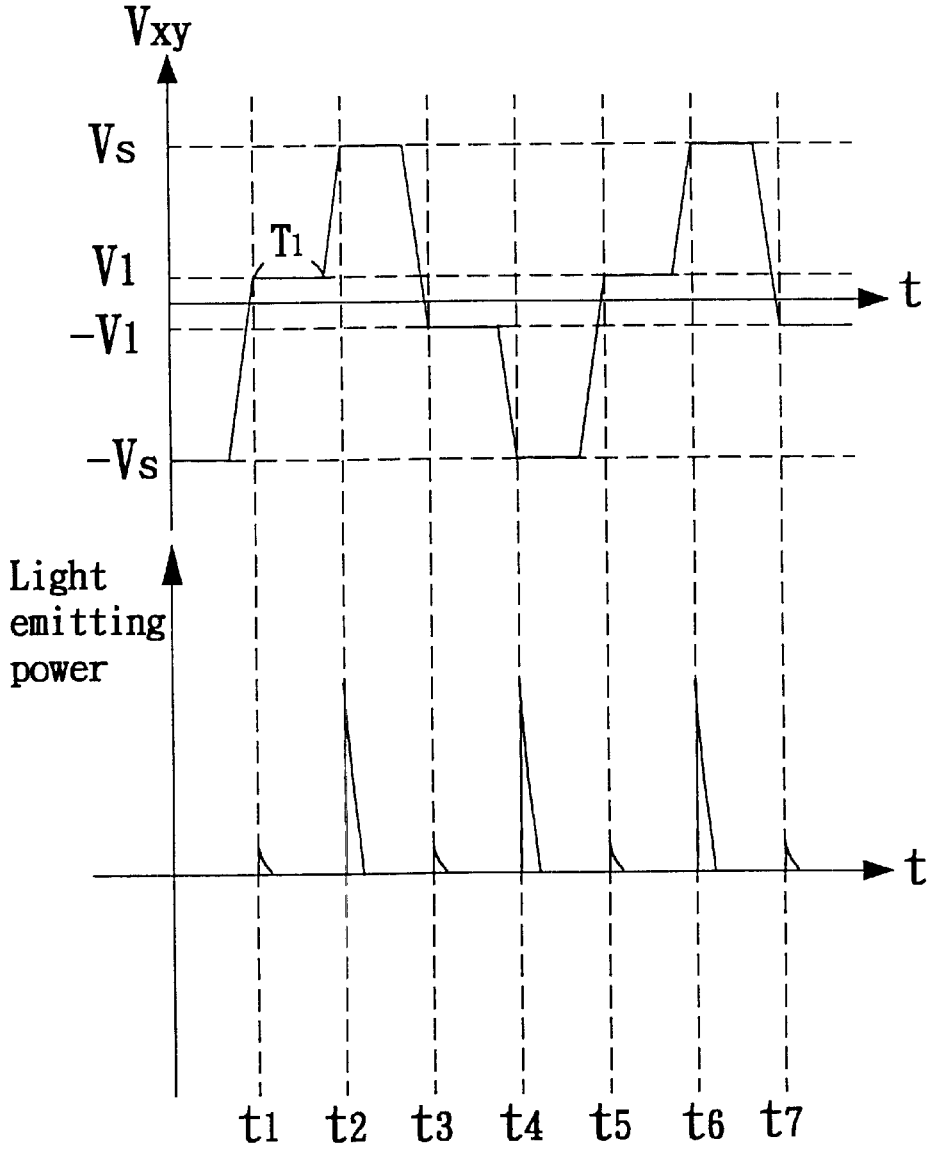
FIG. 2 (PRIOR ART)
FIG. 2 shows another sustaining waveform differed from the one in FIG. 1.

In FIG. 6, $V_{XY}$ is not maintained at $V_2$ (or $-V_2$) for a period of time, but returns to a voltage close to ground right after the self-erase discharge occurs, and maintained at that substantially ground voltage for a time period $T_2$. This differs from the conventional one shown in FIG. 2. During the idle period $T_2$, the space charge would remains in the discharge space 314 and the wall charge needed for the next main discharge does not decrease. Moreover, the peak voltage $V_2$ of the assistant pulse can highly arise up to about 50 V. Compared to the peak voltage of the conventional assistant pulse, which is about 10 to 20 V, the peak voltage $V_2$ according to the preferred embodiment of the invention is much higher. Therefore, the luminance during the self-erase discharge highly increases and much more space charge is produced. Consequently, the firing voltage of the main discharge is lowered.

Figure 7:
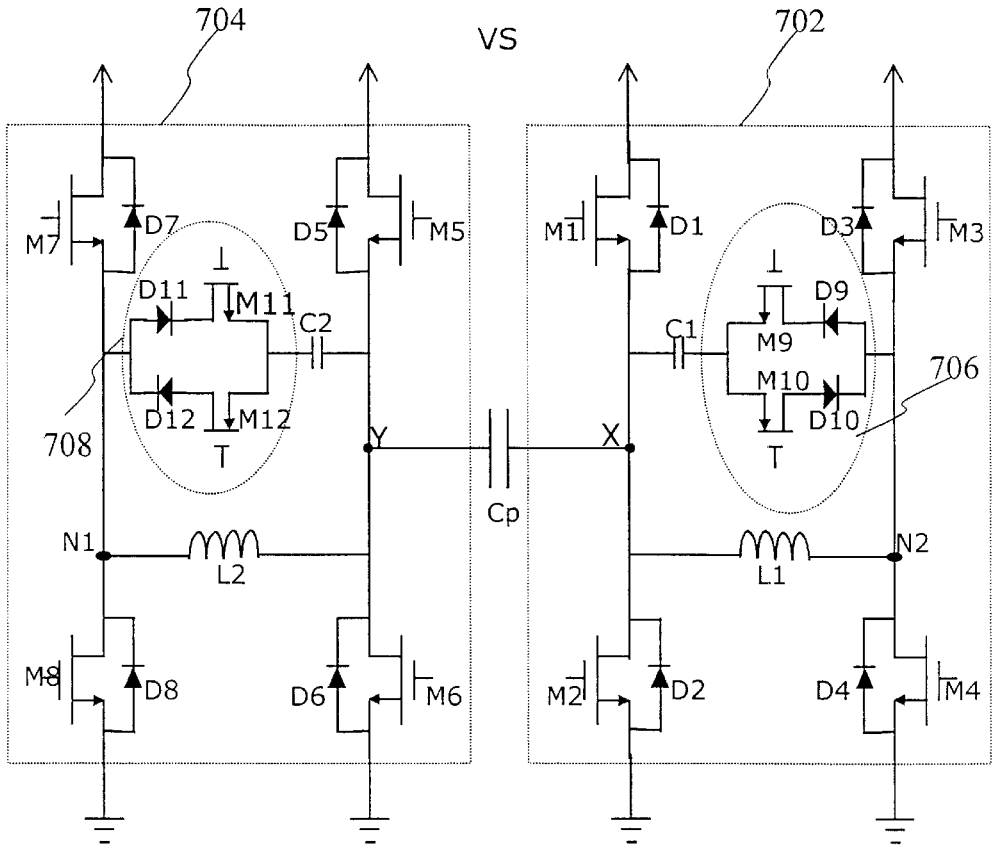
FIG. 7 shows the driving circuit corresponding to the sustaining waveform shown in FIG. 6.

FIG. 7 shows the driving circuit corresponding to the sustaining waveform shown in FIG. 6. The driving circuit includes an energy recovery circuit 702(not including the capacitor C1 and bidirectional switch 706), an energy recovery circuit 704(not including the capacitor C2 and bi-directional switch 708), a capacitor C1, a bi-directional switch 706, a capacitor C2, a bi-directional switch 708 and a power supply VS for providing a driving voltage. The energy recovery circuit 702 is connected to the sustain electrode X and the energy recovery circuit 704 is connected to the sustain electrode Y. The energy recovery circuit 702 includes switches M1, M2, M3, and M4; diodes D1, D2, D3, and D4; and an inductor L1. The switch M1 and the diode D1 are connected in parallel between the sustain electrode X and the power supply VS. The switch M2 and the diode D2 are connected in parallel between the sustain electrode X and ground. The inductor L1 is connected between the sustain electrode X and a node N1. The switch M3 and the diode D3 are connected in parallel between the node N1 and the power supply VS. The switch M4 and the diode D4 are connected in parallel between the node N1 and ground. Herein, each of the switches is a transistor.

Similarly, the energy recovery circuit 704 includes switches M5, M6, M7, and M8; diodes D5, D6, D7, and D8; and an inductor L2. The switch M5 and the diode D5 are connected in parallel between the sustain electrode Y and the power supply VS. The switch M6 and the diode D6 are connected in parallel between the sustain electrode Y and ground. The inductor L2 is connected between the sustain electrode Y and a node N2. The switch M7 and the diode D7 are connected in parallel between the node N2 and the power supply VS. The switch M8 and the diode D8 are connected in parallel between the node N2 and ground.

The capacitor C1 and the bi-directional switch 706 are connected in series between the sustain electrode X and the node N1. The capacitor C2 and the bi-directional switch 708 are connected in series between the sustain electrode Y and the node N2. Effective panel capacitance Cp exists between the sustain electrode X and the sustain electrode Y.

Furthermore, the bidirectional switch 706 includes switches M9, M10, and diodes D9, D10. The switch M9 and the diode D9 are connected in series, the switch M10 and the diode D10 are connected in series. The combination of the switch M9 and the diode D9 are in parallel with the combination of the switch M10 and the diode D10. Similarly, the bi-directional switch 708 includes switches M11, M12, and diodes D11, D12. The switch M11 and the diode D11 are connected in series, the switch M12 and the diode D12 are connected in series, and the combination of the switch M11 and the diode D11 are connected in parallel with the combination of the switch M12 and the diode D12.

The driving circuit according to the preferred embodiment of the invention approaches the goal of energy saving by recovering the energy stored in the panel capacitance Cp back to the capacitor $C_O$ (not shown) of the output stage of the power supply VS. The operation of the driving circuit is described as follows.

Figure 8:
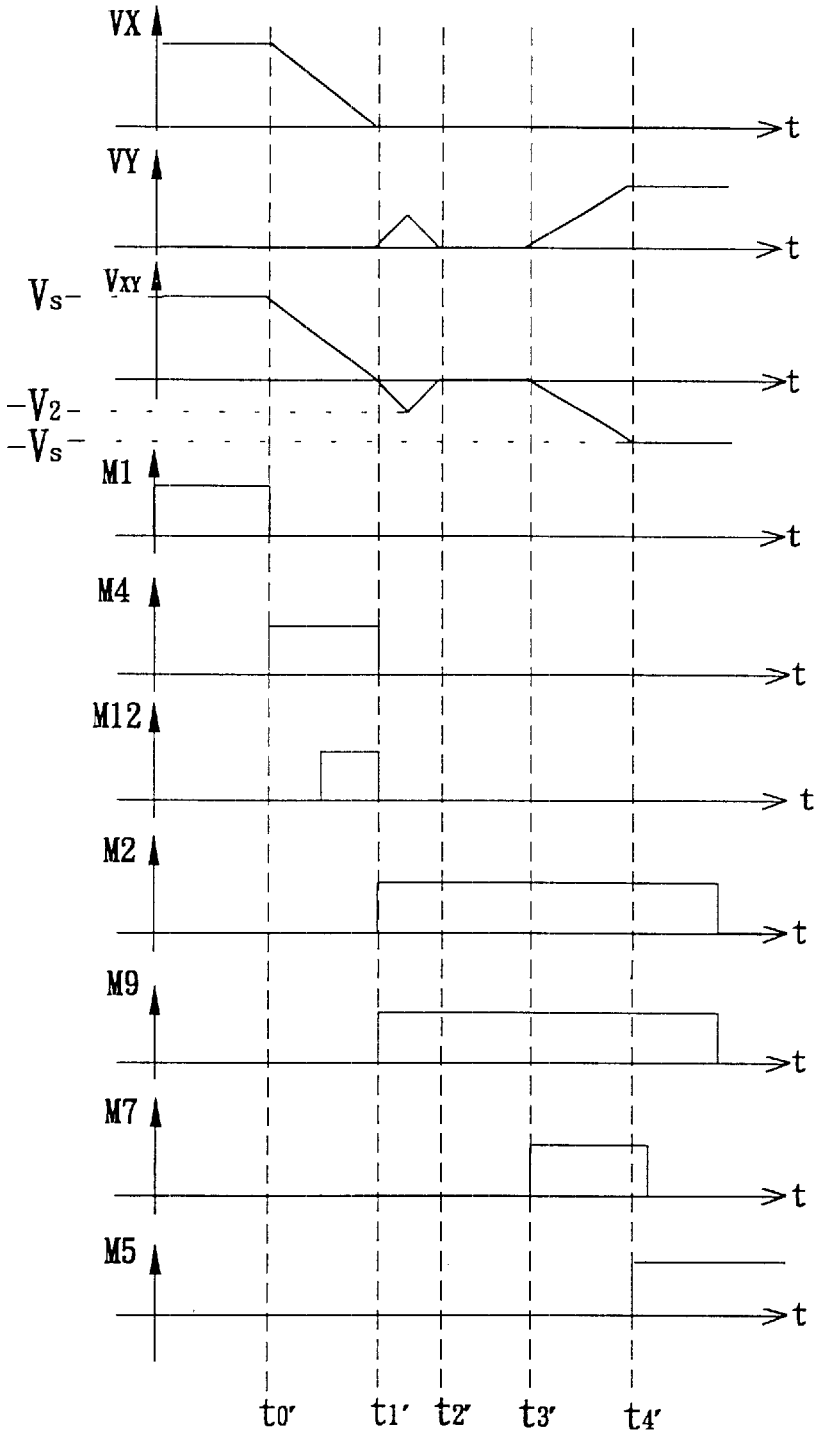
FIG. 8 shows the signals of the sustain electrodes X and Y and $V_{xy}$, and a partial list of the controlling signals of the switches.

Referring to FIG. 8, the voltage variation of the sustain electrodes X and Y and $V_{XY}$, and a partial list of the controlling signals of the switches are shown. Assume the switches M1 and M6 are ON before $t_0$', and the initial voltage of $V_{XY}$ is equal to the sustain voltage Vs. The current flowing through the inductor L1 is denoted by inductor current 11, while the current flowing through the inductor L2 is denoted by inductor current 12.

$$t_0' \leqq t \leqq t_1' \quad (1)$$

At $t_0$', the switch M4, M12 are turned ON, and the switch M1 is turned OFF. The inductor L1 resonates with the panel capacitance Cp. Therefore, the energy in the panel capacitance Cp is transferred to the inductor L1 and the voltage of the sustain electrode X decreases while current flows to ground through the inductor L1 and the switch M4. When the voltage of the sustain electrode X becomes zero, the diode D2 is turned ON.

On the other hand, when the switch M12 is turn on during $t_0$' to $t_1$', the energy in the capacitor C2 which was charged upto Vs in the previous cycle is transferred to the inductance L2 due to the resonant of the capacitor C2 and the inductor L2.

$$t_1' \leqq t \leqq t_2' \quad (2)$$

At $t_1$', the switch M4, M6, M12 are turned OFF and the switch M9, M2 are turned ON. Then, the current of the inductor L1 flows to the capacitor C1 through the switch M9 and the diode D9 due to the continuity of the inductor current 11. Thus, the voltage of the node N1 increases. Because the capacitance of the capacitor C1 is much smaller than the panel capacitance Cp, a part of energy in the inductor L1 will transfer to the capacitor C1 while another part of energy in the inductor L1 will transfer to the capacitor $C_O$ of the output stage of the power supply VS. When the voltage of the node N1 reaches Vs, the current of the inductor L1 will flow to the power supply VS thorough the diode D3 and the residual energy in the inductor L1 will restore in the capacitor $C_O$ of the output stage of the power supply VS.

On the other hand, the energy in the inductor L2 which is transferred from the capacitor C1 before $t_1$ is transferred to the sustain electrode Y of the panel capacitance Cp through the switch M2. When the voltage of the sustain electrode Y reaches $V_2$ ($V_{XY}=-V_2$), the self-erase discharge occurs and the voltage of the sustain electrode Y decreases to zero($V_{XY}=0$) because all the energy in the panel capacitance Cp is dissipated due to the self-erase discharge.

$$t_2' \leqq t \leqq t_3' \quad (3)$$

There is no ON-OFF switching for all switches, both voltages of the sustain electrodes X and Y are maintained in ground voltage for this time period $T_2$. The space charge is not attracted to the sustain electrodes X and Y, and remains in the discharge space 314. Therefore, the firing voltage of the main discharge can be lowered.

$$t_3' \leqq t \leqq t_4' \quad (4)$$

At $t_3'$, the switch M7 is turned ON and the switch M9 is turned OFF. The power supply VS begins to charge the panel capacitance Cp through the inductor L2 and the switch M7. The voltage of the sustain electrode Y is increased, i.e., the voltage $V_{XY}$ is decreased from ground voltage.

$$t_4' \leqq t \quad (5)$$

At $t_4'$, while the voltage of the sustain electrode Y reaches $V_S$, the diode D5 is turned ON. Meanwhile, the switch M5 is turned ON and the switch M7 is turned OFF. The discharging current of the main discharge is provided from the capacitor $C_O$ of the output stage of the power supply VS, and the inductor current 12 will flow back to the power supply VS.

Herein, the operation of the switches is described by taking half cycle as an example. The operation of the other half cycle follows the same principle. For example, during the other half cycle, the operation of the switch M5 is similar to that of the switch M1, the operation of the switch M6 is similar to that of the switch M2, the operation of the switch M7 is similar to that of the switch M3, and the operation of the switch M8 is similar to that of the switch M4.

After the self-erase discharge, the luminance of the main discharge decreases and the luminous efficiency increases. However, if the capacitance of the capacitor C1 or the capacitor C2 is too large, the voltage of sustain electrode Y does not return to zero because the energy stored in capacitors C1 and C2 will be more than the energy that dissipates in the self-erase discharge. Thus, precise control of the switches in the circuit is needed to make the voltage of sustain electrode Y return to zero during period $T_2$.

Moreover, the driving circuit still maintains the function of energy recovery, which has the character that the energy in the panel capacitance Cp is restored into the power supply VS through the inductors L1 and L2 even if the capacitors C1 and C2 and the bidirectional switches 706 and 708 are removed.

Figure 9:
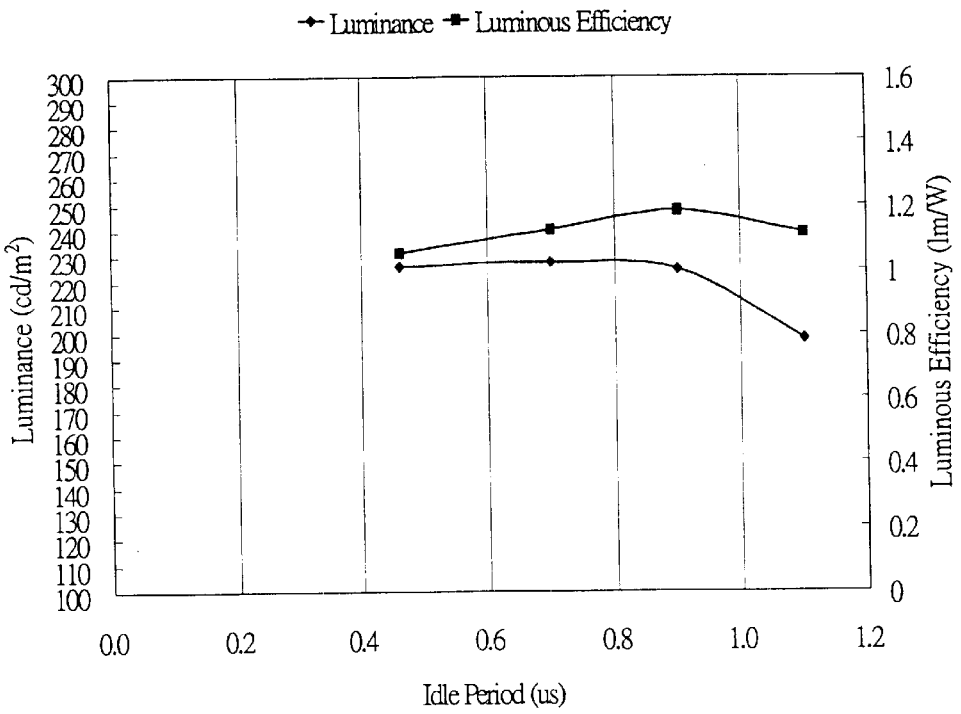
FIG. 9 shows the experimental results of a 42-inch ACPDP which indicates the relation of the luminance and the luminous efficiency under various idle periods of the sustaining waveform in FIG. 6.

FIG. 9 shows the experimental results of a 42-inch ACPDP. The relation of the luminance and the luminous efficiency under various idle period of the sustaining waveform is shown in FIG. 6. The luminance does not change a lot even if the idle period $T_2$ is 0.9 $\mu$s. In other words, when the idle period $T_2$ is 0.9 $\mu$s, the main discharge does not become too weak. It is deduced that the possibility of decreasing the wall charge needed for the main discharge during the idle period $T_2$ can be reduced by way of the sustaining waveform as shown in FIG. 6.

Figure 10:
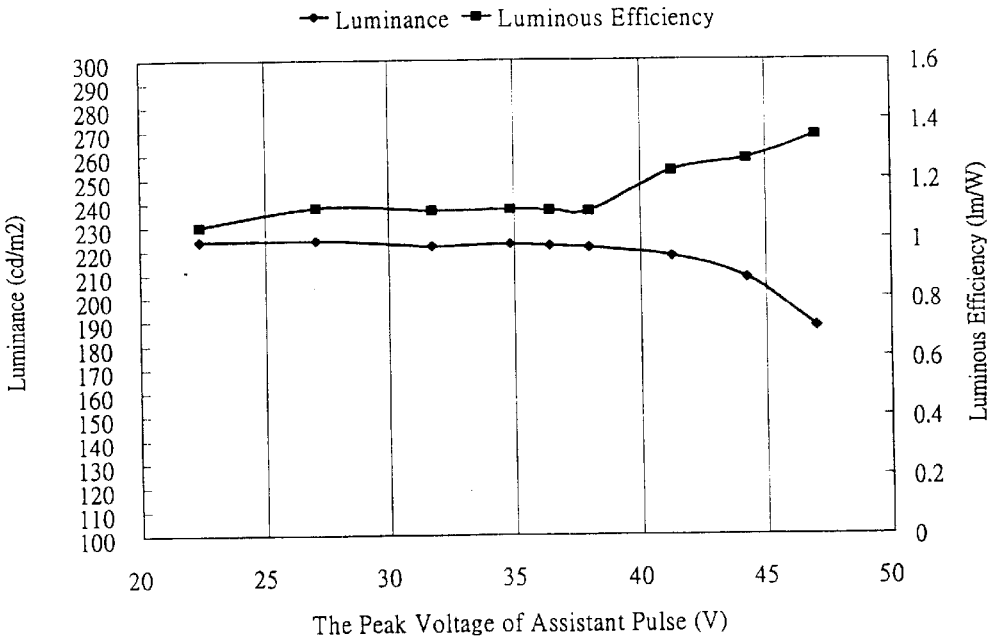
FIG. 10 shows the experimental results of a 42-inch ACPDP which indicates the relation of the luminance and the luminous efficiency under various peak voltages of the assistant pulse.

FIG. 10 shows the experimental results of a 42-inch ACPDP which indicate the relation of the luminance and the luminous efficiency under various peak voltages of the assistant pulse. It has been found that the main discharge will be more efficient when the self-erase discharge highly enhances, which is due to higher peak voltage $V_2$ of the assistant pulse. The 30% enhancement of the luminous efficiency is achieved in the situation of only 7% falling in the luminance of ACPDP when the peak voltage $V_2$ of the assistant pulse is 44 V.

Figure 11:
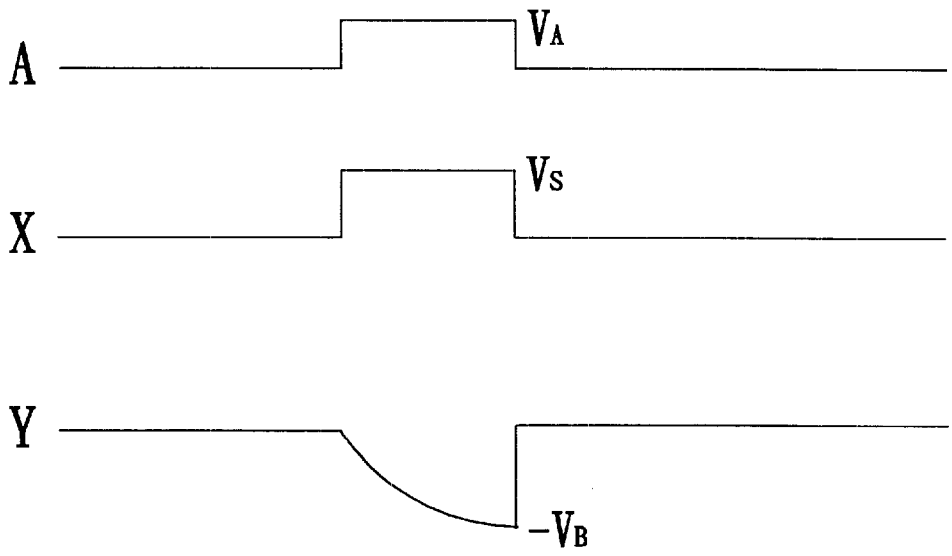
FIG. 11 shows the preferred priming waveform corresponding to the sustaining waveform in FIG. 6.

FIG. 11 shows the preferred priming waveform corresponding to the sustaining waveform in FIG. 6. A pulse which gradually decreases to voltage $-V_B$ is applied to the sustain electrode Y. A pulse of Vs is applied to the sustain electrode X. A pulse of $V_A$ is applied to the address electrode A. Because of the gradually smoothly decreasing (curved shaped) voltage of the sustain electrode Y, high uniformity in the reset period and consequently high stability of the sustaining operation can be achieved.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for driving a plasma display panel having first sustain electrodes, second sustain electrodes, and address electrodes, the first sustain electrodes being arranged in parallel with the second sustain electrodes, the address electrodes being arranged orthogonal to the first sustain electrodes and said second electrodes, the first sustain electrodes and the second sustain electrodes intersecting with the address electrodes to form intersections which define discharge cells that can be selectively turned ON and OFF, the method comprising:

applying erasing pulses and priming pulses to the discharge cells;

turning on some of the discharge cells; and sustaining discharging in the discharge cells to emit light pulses continuously, the method of sustaining discharging comprising:

(a) applying a first pulse of a first positive voltage between the first sustain electrodes and the second sustain electrodes;

(b) maintaining a second positive voltage for a first time period between the first sustain electrodes and the second sustain electrodes;

(c) applying a second pulse of a third positive voltage between the first sustain electrodes and the second sustain electrodes;

(d) applying a third pulse of a first negative voltage between the first sustain electrodes and the second sustain electrodes;

(e) maintaining a second negative voltage for a second time period between the first sustain electrodes and the second sustain electrodes; and (f) applying a fourth pulse of a third negative voltage between the first sustain electrodes and the second sustain electrodes;

wherein the second positive voltage is lower than the first positive voltage and the third positive voltage, and the second negative voltage is higher than the first negative voltage and the third negative voltage.

2. A method according to claim 1, wherein the second positive voltage and the second negative voltage are substantially close to a ground voltage.

3. A method according to claim 1, wherein the method of applying the priming pluses comprising:

applying fifth pulses which decreases to a fourth negative voltage gradually to the second sustain electrodes, applying sixth pulses of a fourth positive voltage to the first sustain electrodes, and applying seventh pulses of the a fifth positive voltage to the address electrodes.

4. A method for sustaining discharging in the discharge cells of a plasma display panel (PDP) having first sustain electrodes, second sustain electrodes, and address electrodes, the first sustain electrodes being arranged in parallel with the second sustain electrodes, the address electrodes being arranged orthogonal to the first sustain electrodes and the second electrodes, the first sustain electrodes and the second sustain electrodes intersecting with the address electrodes to form intersections which define discharge cells that can be selectively turned ON and OFF, the method comprising:

(a) applying a first pulse of a first positive voltage between the first sustain electrodes and the second sustain electrodes;

(b) maintaining a second positive voltage for a first period between the first sustain electrodes and the second sustain electrodes;

(c) applying a second pulse of a third positive voltage between the first sustain electrodes and the second sustain electrodes;

(d) applying a third pulse of a first negative voltage between the first sustain electrodes and the second sustain electrodes;

(e) maintaining a second negative voltage for a second period between the first sustain electrodes and the second sustain electrodes; and (f) applying a fourth pulse of a third negative voltage between the first sustain electrodes and the second sustain electrodes;

wherein the second positive voltage is lower than the first positive voltage and the third positive voltage, and the second negative voltage is higher than the first negative voltage and the third negative voltage.

5. A method according to claim 4, wherein the second positive voltage and the second negative voltage are a ground voltage.

6. An apparatus for providing sustaining waveform to a selected discharge cell of a plasma display panel (PDP), wherein the selected discharge cell is defined by a first sustain electrode, a second sustain electrode which is parallel to the first sustain electrode, and an address electrode which is orthogonal to the first sustain electrode and second sustain electrode, the apparatus comprising:

a power supply for providing a driving voltage;

a first energy recovery circuit connecting to the first sustain electrode, wherein the first energy recovery circuit comprises a first switch connected between the first sustain electrode and the power supply, a second switch connected between the first sustain electrode and a ground node, a first inductor connected between the first sustain electrode and a first node, a third switch connected between the first node and the power supply, and a fourth switch connected between the first node and the ground node; a first diode connecting in parallel to the first switch, a second diode connecting in parallel to the second switch, a third diode connecting in parallel to the third switch, a fourth diode connecting in parallel to the fourth switch;

a second energy recovery circuit connecting to the second sustain electrode wherein the second energy recovery circuit comprises a fifth switch connected between the second sustain electrode and the power supply, a sixth switch connected between the second sustain electrode and the ground node, a second inductor connected between the second sustain electrode and a second node, a seventh switch connected between the second node and the power supply, and an eighth switch connected between the second node and the ground node; a fifth diode connecting in parallel to the fifth switch, a sixth diode connecting in parallel to the sixth switch, a seventh diode connecting in parallel to the seventh switch, and an eighth diode connecting in parallel to the eighth switch;

a first capacitor and a first bisdirectional switch which are connected in series between the first sustain electrode and the first node; and a second capacitor and a second bindirectional switch which are connected in series between the second sustain electrode and the second node.

7. An apparatus according to claim 6, further comprising:

means for controlling the first energy recovery circuit and the second energy recovery circuit to supply energy to the panel capacitor from the power supply alternately, and restore energy to the power supply alternately; and means for controlling the first capacitor to temporarily receive energy from the first inductor and controlling the second capacitor to temporarily receive energy from the second inductor alternately.

8. An apparatus according to claim 6, wherein each of the bi-directional switches comprises:

a first transistor connected in series with an eleventh diode; and a second transistor connected in series with a twelfth diode;

wherein the combination of first transistor and the eleventh diode are connected in parallel with the combination of second transistor and the twelfth diode.

* * * * *